US009123328B2

(12) United States Patent
Mittal et al.

(10) Patent No.: US 9,123,328 B2
(45) Date of Patent: Sep. 1, 2015

(54) APPARATUS AND METHOD FOR AUDIO FRAME LOSS RECOVERY

(71) Applicant: MOTOROLA MOBILITY LLC, Libertyville, IL (US)

(72) Inventors: Udar Mittal, Hoffman Estates, IL (US); James P. Ashley, Naperville, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 208 days.

(21) Appl. No.: 13/626,938

(22) Filed: Sep. 26, 2012

(65) Prior Publication Data

US 2014/0088974 A1 Mar. 27, 2014

(51) Int. Cl.

| | |
|---|---|
| ***G10L 19/00*** | (2013.01) |
| ***G10L 21/00*** | (2013.01) |
| ***G10L 19/005*** | (2013.01) |
| ***G10L 19/18*** | (2013.01) |

(52) U.S. Cl.

CPC ..... *G10L 19/005* (2013.01); *G10L 19/18* (2013.01)

(58) Field of Classification Search

CPC ..... G10L 19/005; G10L 19/18
USPC ..... 704/205, 211, 228, 500, 219
See application file for complete search history.

(56) References Cited

U.S. PATENT DOCUMENTS

| | | | | |
|---|---|---|---|---|
| 6,073,092 | A * | 6/2000 | Kwon | 704/219 |
| 6,134,518 | A * | 10/2000 | Cohen et al. | 704/201 |
| 6,199,035 | B1 * | 3/2001 | Lakaniemi et al. | 704/207 |
| 6,804,639 | B1 * | 10/2004 | Ehara | 704/223 |
| 7,577,565 | B2 * | 8/2009 | Anandakumar et al. | 704/208 |
| 7,587,315 | B2 * | 9/2009 | Unno | 704/223 |
| 7,596,489 | B2 * | 9/2009 | Kovesi et al. | 704/219 |
| 7,774,203 | B2 * | 8/2010 | Wang et al. | 704/254 |
| 7,805,297 | B2 * | 9/2010 | Chen | 704/228 |
| 7,991,621 | B2 * | 8/2011 | Oh et al. | 704/500 |
| 8,015,000 | B2 * | 9/2011 | Zopf et al. | 704/208 |
| 2003/0009325 | A1 * | 1/2003 | Kirchherr et al. | 704/211 |

(Continued)

FOREIGN PATENT DOCUMENTS

EP 0932141 A2 7/1999

OTHER PUBLICATIONS

Krishnan, et al., "EVRC-Wideband: The New 3GGP2 Wideband vocoder standard" ICASSP, 2007, 4 pages.

(Continued)

*Primary Examiner* — Shaun Roberts
(74) *Attorney, Agent, or Firm* — Birch, Stewart, Kolasch & Birch, LLP

(57) ABSTRACT

A method and apparatus provides for frame loss recovery following a loss of a frame in an audio codec. The lost frame is identified. Estimated linear predictive coefficients of a previous transform frame are generated based on a decoded audio of the previous transform frame. An estimated residual of the previous transform frame is generated based on the estimated linear predicative coefficients and the decoded audio. A pitch delay is determined from frame error recovery parameters received with the previous transform frame. An extended residual is generated based on the pitch delay and the estimated residual. A first synthesized signal is generated based on the extended residual and the linear predicative coefficients. A decoded audio output of at least the lost frame is generated based on the first synthesized signal. The frame error recovery parameters are generated by an encoder.

6 Claims, 6 Drawing Sheets

(56) References Cited

U.S. PATENT DOCUMENTS

| | | | | |
|---|---|---|---|---|
| 2003/0074197 | A1* | 4/2003 | Chen | 704/262 |
| 2005/0154584 | A1 | 7/2005 | Jelinek et al. | |
| 2008/0046233 | A1* | 2/2008 | Chen et al. | 704/211 |
| 2010/0305953 | A1 | 12/2010 | Susan et al. | |
| 2011/0173008 | A1* | 7/2011 | Lecomte et al. | 704/500 |

OTHER PUBLICATIONS

ITU-T G.718, "Series G: Transmission Systems and Media, Digital Systems and Networks; Digital terminal equipments—Coding of voice and audio signals; Frame error robust narrow-band and wideband embedded variable bit-rate coding of speech and audio from 8-32 kbit/s", Jun. 2008, 157 pages.

ITU-T G.711 Appendix I "Series G: Transmission Systems and Media, Digital Systems and Networks; Digital transmission systems—Terminal equipments—Coding of analogue signals by pulse code modulation; Pulse code modulation (PCM) of voice frequencies; Appendix I: A high quality low-complexity algorithm for packet loss concealment with G.711" Sep. 1999, 26 pages.

Milan Jelinek et al.: "ITU-T G.EV-VBR baseline codec", Acoustics, Speech and Signal Processing, 2008, ICASSP 2008, IEEE International Conference on, IEEE, Piscataway, NJ, USA, Mar. 31, 2008, pp. 4749-4752.

Huan Hou et al.: "Real-time audio error concealment method based on sinusoidal model", Audio, Language and Image Processing, 2008, ICALIP 2008, International Conference on, IEEE, Piscataway, NJ, USA, Jul. 7, 2008, pp. 22-28.

Patent Cooperation Treaty, International Search Report and Written Opinion of the International Searching Authority for International Application No. PCT/US2013/058378, Jan. 30, 2014, 13 pages.

Combesure, Pierre et al.: "A 16, 24, 32 kbit/s Wideband Speech Codec Based on ATCELP", Proceedings ICASSP '99 Proceedings of the Acoustics, Speech, and Signal PRocessing, 1999, on 1999 IEEE International Conference, vol. 01, pp. 5-8.

* cited by examiner

APPARATUS AND METHOD FOR AUDIO FRAME LOSS RECOVERY

FIELD OF THE INVENTION

The present invention relates generally to audio encoding/decoding and more specifically to audio frame loss recovery.

BACKGROUND

In the last twenty years microprocessor speed has increased by several orders of magnitude and Digital Signal Processors (DSPs) have become ubiquitous. As a result, it has become feasible and attractive to transition from analog communication to digital communication. Digital communication offers the advantage of being able to utilize bandwidth more efficiently and allows for error correcting techniques to be used. Thus, by using digital communication, one can send more information through an allocated spectrum space and send the information more reliably. Digital communication can use wireless links (e.g., radio frequency) or physical network media (e.g., fiber optics, copper networks).

Digital communication can be used for transmitting and receiving different types of data, such as audio data (e.g., speech), video data (e.g., still images or moving images) or telemetry. For audio communications, various standards have been developed, and many of those standards rely upon frame based coding in which, for example, high quality audio is encoded and decoded using audio frames (e.g., 20 millisecond frames containing information that describes the audio that occurs during the 20 milliseconds). For certain wireless systems, audio coding standards have evolved that use sequentially mixed time domain coding and frequency domain coding. Time domain coding is typically used when the source audio is voice and typically involves the use of CELP (code excited linear prediction) based analysis-by-synthesis coding. Frequency domain coding is typically used for such non-voice sources such as music and is typically based on quantization of MDCT (modified discrete cosine transform) coefficients. Frequency domain coding is also referred to "transform domain coding." During transmission, a mixed time domain and transform domain signal may experience a frame loss. When a device receiving the signal decodes the signal, the device will encounter the portion of the signal having the frame loss, and may request that the transmitter resend the signal. Alternatively, the receiving device may attempt to recover the lost frame. Frame loss recovery techniques typically use information from frames in the signal that occur before and after the lost frame to construct a replacement frame.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description, which describes embodiments of the invention. The description is meant to be taken in conjunction with the accompanying drawings in which:

Figure 1:
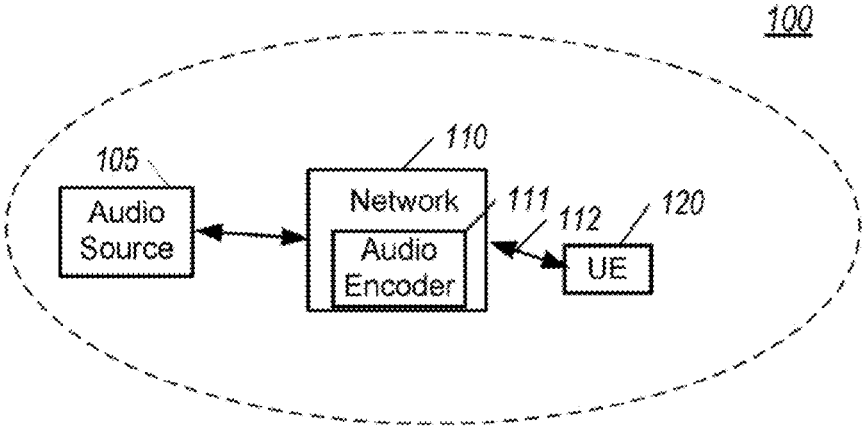
FIG. 1 is a diagram of a portion of a communication system, in accordance with certain embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

Embodiments described herein provide a method of generating an audio frame as a replacement for a lost frame when the lost frame directly follows a transform domain coded audio frame. The decoder obtains pitch information related to the transform domain frame that precedes the first lost frame and uses that to construct replacement audio for the lost frame. The technique provides a replacement frame that has reduced distortion compared to other techniques.

Referring to FIG. 1, a diagram of a portion of a communication system 100 is shown, in accordance with certain embodiments. The portion of the communication system 100 includes an audio source 105, a network 110, and a user device (also referred to as user equipment, or UE) 120. The audio source 105 may be one of many types of audio sources, such as another UE, or a music server, or a media player, or a personal recorder, or a wired telephone. The network 110 may be a point to point network or a broadcast network, or a plurality of such networks coupled together. There may be a plurality of audio sources and UE's in the communication system 100. The UE 120 may be a wired or wireless device. In one example, the UE 120 is a wireless communication device (e.g., a cell phone) and the network 110 includes a radio network station to communicate to the UE 120. In another example, the network 110 includes an IP network that is coupled to the UE 120, and the UE 120 comprises a gateway coupled to a wired telephone. The communication system 100 is capable of communicating audio signals between the audio source 105 and the UE 120. While embodiments of the UE 120 described herein are described as being wireless devices, they may alternatively be wired devices using the types of coding protocols described herein. Audio from the audio source 105 is communicated to the UE 120 using an audio signal that may have different forms during its conveyance from the audio source 105 to the UE 120. For example, the audio signal may be an analog signal at the audio source that is converted to a digitally sampled audio signal by the network 110. An Audio Encoder 111 in the Network 110 makes a conversion of the audio signal it receives to a form that uses audio compression encoding techniques that are optimized for conveying a sequential mixture of voice and non voice audio in a channel or link that may induce errors. It is then packaged in a channel protocol that may add metadata and error protection, and modulate the packaged signal for RF or optical transmission. The modulated signal is then transmitted as a channel signal 112 to the UE 120. At the UE 120, the channel signal 112 is demodulated and unpackaged and the compressed audio signal is received in a decoder of the UE 120.

The voice audio can be effectively compressed by using certain time domain coding techniques, while music and other non-voice audio can be effectively compressed by certain transform domain encoding (frequency encoding) techniques. In some systems, CELP (code excited linear prediction) based analysis-by-synthesis coding is the time domain coding technique that is used. The transform domain coding is typically based on quantization of MDCT (modified discrete cosine transform) coefficients. The audio signal received at the UE 120 is a mixed audio signal that uses time domain coding and transform domain coding in a sequential manner. Although the UE 120 is described as a user device for the embodiments described herein, in other embodiments it may be a device not commonly thought of as a user device. For example, it may be an audio device used for presenting audio for a movie in a cinema. The network 110 and UE 120 may communicate in both directions using an audio frame based communication protocol, wherein a sequence of audio frames is used, each audio frame having a duration and being encoded with compression encoding that is appropriate for the desired audio bandwidth. For example, analog source audio may be digitally sampled 16000 times per second and sequences of the digital samples may be used to generate compression coded audio frames every 20 milliseconds. The compression encoding (e.g., CELP and/or MDCT) conveys the audio signal in a manner that has an acceptably high quality using far fewer bits than the quantity of bits resulting directly from the digital sampling. It will be appreciated that the frames may include other information such as error mitigation information, a sequence number and other metadata, and the frames may be included within groupings of frames that may include error mitigation, sequence number, and metadata for more than one frame. Such frame groups may be, for example, packets or audio messages. It will be appreciated that in some embodiments, most particularly those systems that include packet transmission techniques, frames may not be received sequentially in the order in which they are transmitted, and in some instances a frame or frames may be lost.

Some embodiments are designed to handle a mixed audio signal that changes between voice and non-voice by providing for changing from time domain coding to transform domain coding and also from transform domain coding to time domain coding. When changing from a transform domain portion of the audio signal to a subsequent time domain portion of the audio signal, the first frame that is transform coded is called the transform domain to time domain transition frame. As used herein decoding means generating, from the compressed audio encoded within each frame, a set of audio sample values that may be used as an input to a digital to analog converter. The method that is typically used for encoding and decoding transform coded frames (MDCT transform) results, at the output of the decoder in a set of audio samples representing each audio frame as well as a set of audio samples called MDCT synthesis memory samples that are usable for decoding the next audio frame.

Figure 2:
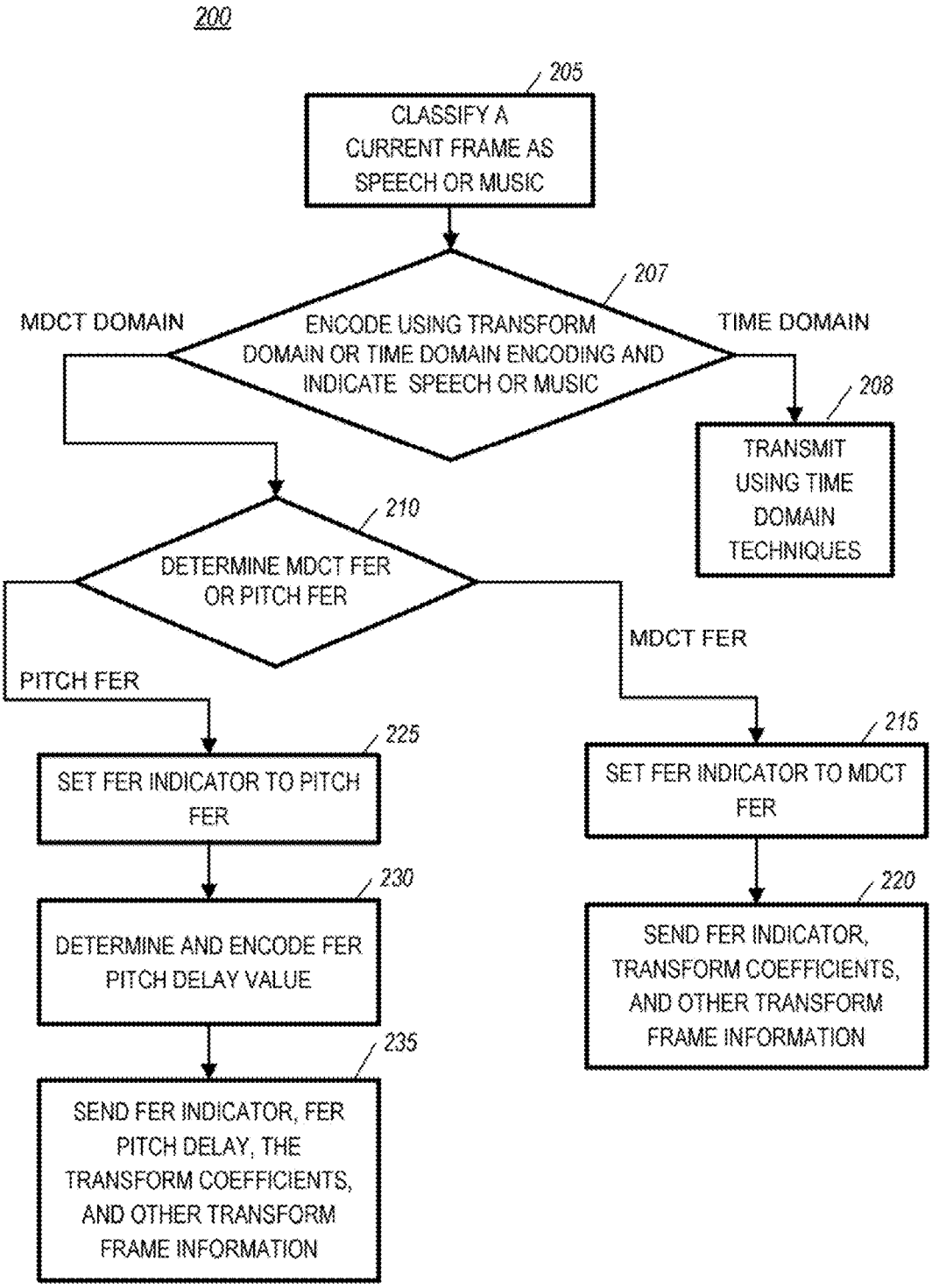
FIG. 2 is a flow chart that shows some steps of a method for classifying encoded frames in an encoder of a mixed audio system, in accordance with certain embodiments.

In some embodiments, frame error recovery bits are added by the encoder 111 to certain defined ones or all of the transform domain encoded frames that are determined to be pitch based framer error recovery transform domain type frames. Referring to FIG. 2, a flow chart 200 shows some steps of a method for classifying encoded frames in an encoder of a mixed audio system, in accordance with certain embodiments. At step 205, a frame encoder receives a current frame from a frame source and determines for each frame a classification as either being a speech or a music frame. This determination is then provided as an indication to at least the transform stage of encoding (step 207). The description "music" includes music and other audio that is determined to be non-voice. At step 207, a domain type is determined for each frame. In certain situations all frames in a particular transmission may be transform domain encoded. In other situations all frames in a particular transmission may be time domain encoded. In other situations, a particular transmission may use, in sequences, time domain and transform domain encoding, which is also called mixed encoding. When mixed encoding is used, time domain encoding of frames is used when a sequence of frames includes a preponderance of speech frames and transform domain encoding of frames is used when a sequence of frames includes a preponderance of music frames. This may be accomplished, for example, by a determination method that uses hysteresis, so that changes between time domain and transform domain encoding do not occur when there are very few consecutive frames of one (speech or music) type before the domain type again changes. Therefore, in mixed coding transmission and in transform domain only coding transmissions, a particular transform domain frame can be either music or voice. A speech/music indication and other audio information about the frame is provided with each frame, in addition to the audio compression encoding information.

At step 208, a time domain encoding technique is used to encode and transmit the current frame.

At step 210, which is used in those embodiments in which a speech/music classification is provided, the state of the speech/music indication is determined. A further determination is then made as to whether the current transform frame is to be classified as a pitch based frame error recovery transform domain type of frame (PITCH FER frame) or an MDCT frame error recovery type of frame (MDCT FER frame) based on some parameters received from the audio encoder, such as a speech/music indication, an open loop pitch gain of the frame or part of the frame, and a ratio of high frequency to low frequency energy in the frame. When the open loop gain of the frame is less than an open loop pitch gain threshold then the frame is classified as the MDCT FER frame and when the open loop gain is above the threshold, then the frame is classified as a PITCH FER frame. When the frame is classified as a MDCT FER frame at step 210, an FER indicator (which may be a single but), is set at step 215 to indicate that the frame is a MDCT FER frame and the FER indicator is transmitted to the decoder with other frame information (e.g., coefficients) at step 220. When the frame is classified as a PITCH FER frame, the FER indicator is set at step 225 to indicate a PITCH FER frame. A frame error recovery parameter referred to the FER pitch delay is determined as described below at step 230. The FER indicator and FER pitch delay are transmitted as parameters to the decoder at step 235 with either eight or nine bits that represent the pitch along with other frame information (e.g., coefficients).

In those embodiments in which the speech/music classification is provided, the threshold used to classify the frame as a PITCH FER frame or an MDCT FER frame may be dependent upon whether the frame is classified as speech or music, and may be dependent upon a ratio of high frequency energy versus low frequency energy of the frame. For example, the threshold above which a frame that has been classified as speech becomes classified as a PITCH FER frame may be an open loop gain of 0.5 and the threshold above which a frame that has been classified as music becomes classified as a PITCH FER frame may be an open loop gain of 0.75. Furthermore, in certain embodiments these thresholds may be modifiable based on a ratio of energies (gains) of a range of high frequencies versus a range of low frequencies. For example, the high frequency range may be 3 KHz to 8 KHz and the low frequency range may be 100 Hz to 3 KHz. In certain embodiments the speech and music thresholds are increased linearly with the ratio of energies or in some cases if the ratio is very high (i.e. high frequency to low frequency ratio is more than 5) then the frame is classified as a MDCT FER frame independent of the value of the open loop gain.

Since both the FER classification and the pitch FER information is going to be utilized for frame error recovery of the following frame, and because the parameters representing values near the end of the frame provide better information about the following frame than the parameters at the start of a frame, the classification at step 210 may be based on the open loop pitch gain near the end of the frame. Similarly the pitch delay information determined at step 230 may be based on the pitch delay near the end of the frame. The position that such parameters may represent within a frame may be dependent upon the source of the current frame at step 205. Audio characterization functions associated with certain frame sources (e.g., speech/audio classifiers and audio pitch parameter estimators) may provide parameters from different position ranges of each frame. For example, some speech/audio classifiers provide the open loop pitch gain and the pitch delay for three locations in each frame: the beginning, the middle and the end. In this case the open loop pitch gain and the pitch delay defined to be at the end of the frame would be used. Some audio characterization functions may utilize look-ahead audio samples to provide look ahead values, which would then be used as best estimates of the audio characteristics of the next frame. Thus, the open loop pitch gain and pitch delay values that are selected as frame error recovery parameters are the parameters that are the best estimates for those values for the next frame (which may be a lost frame).

The frame error recovery parameters for pitch in most systems can be determined with significantly better accuracy at the encoder at steps 210 and 230 than at the decoder because the encoder may have information of audio samples from the next frame in its look-ahead buffer.

In the event of a frame loss, if the most recent previous good frame (hereafter, the previous transform frame, or PTF) was a PITCH FER type frame then a combination of a frame repeat approach and pitch based extension approach may be used for frame error mitigation and if the PTF is a MDCT FER frame then just frame repeat approach may be used for frame error mitigation.

Figure 3:
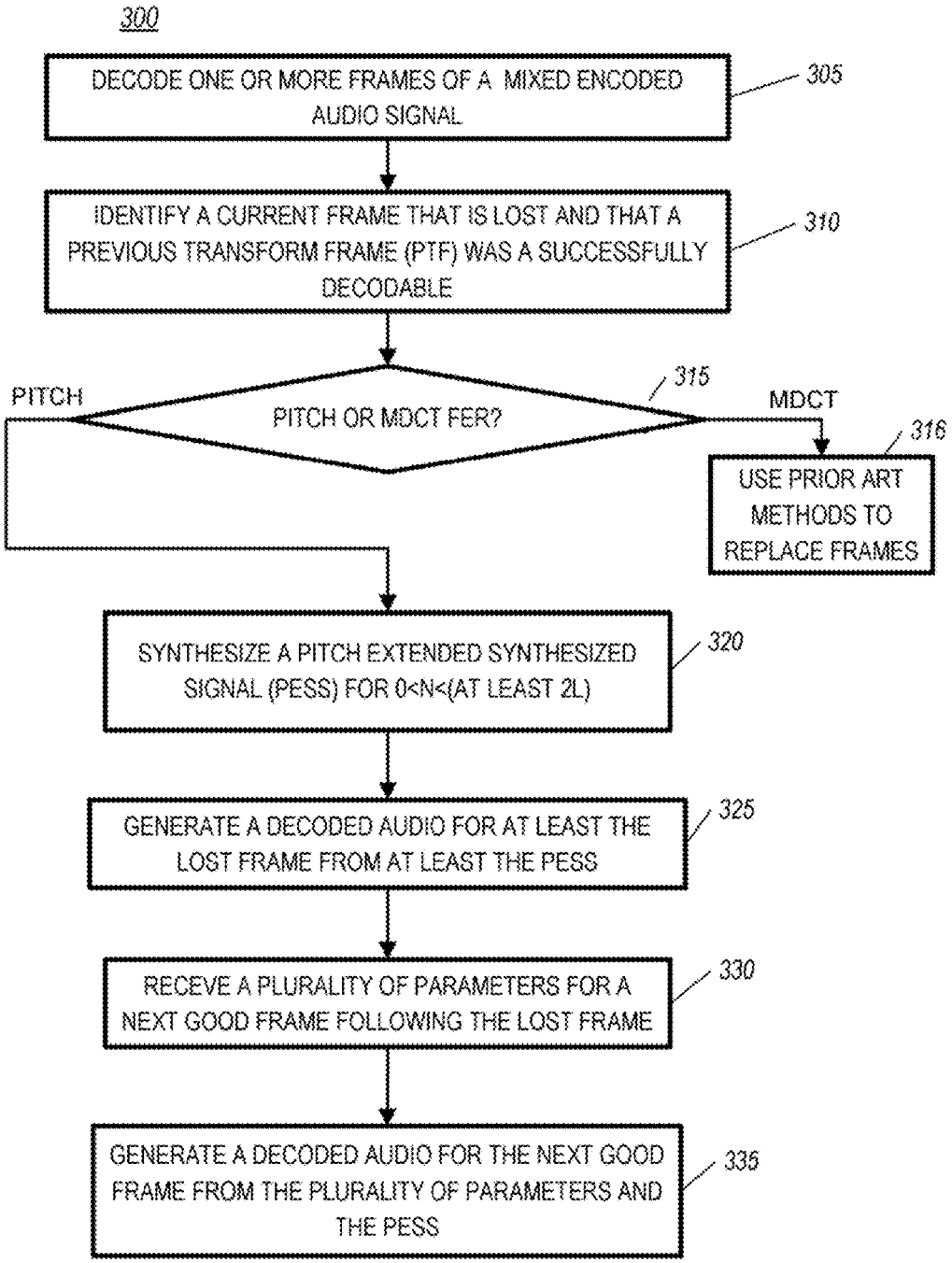
FIG. 3 is a flow chart that shows some steps of method for processing following a loss of a frame in an audio codec, in accordance with certain embodiments.

Referring to FIG. 3, a flow chart 300 shows some steps of method for processing following a loss of a frame in an audio codec, in accordance with certain embodiments. At step 305, one or more transform frames of a mixed encoded audio signal are decoded. At step 310, a current transform frame is identified as being a lost frame. At step 310, a previous transform frame that was successfully decodable, also referred to as the previous transform frame, PTF, is identified. In some embodiments the PTF is the most recent successfully decoded transform frame. At step 315 a determination is made as to whether the PTF is a PITCH FER or MDCT FER frame, using the FER indicator. When a determination is made that the PTF is an MDCT transform frame, then the lost frame may be recovered using known frame repeat methods at step 316. This approach may be used for more than one sequentially lost frame, for example, two or three. At some quantity of lost frames, the decoder may flag the signal as being unrecoverable because the audio has a reconstructed portion that exceeds a value that may be determined by the type of audio.

When a determination is made at step 315 that the PTF is a PITCH FER frame, the FER pitch delay value is determined from the FER parameters sent with the PTF frame at step 315 and a pitch extended synthesized signal (PESS) is synthesized at step 320 using estimated linear predictive coefficients (LPC) of the PTF, the decoded audio of the PTF, and the FER pitch delay of the PTF. The PESS is a signal that extends at least slightly beyond the lost frame and may be extended further if more than of frame is lost. As noted above, there may be a limit at to how many lost frames are decoded by extension in these embodiments, depending on the type of audio. At step 325, a decoded audio for at least the lost frame is generated using at least the PESS. (In some other embodiments later described, the decoded audio is determined further based on audio determined using a frame repeat method based on the transform decoding of the PTF.) At step 330, a plurality of parameters are received for a next good frame that follows the lost frame, which may be a time domain frame, a transfer domain frame, or a transfer domain to time domain transition frame. The parameters for these frames are known and include, depending upon frame type, LPC coefficients and MDCT coefficients. At step 335 a decoded audio is generated from the plurality of parameters. More details for at least two of the above steps follow.

Figure 4:
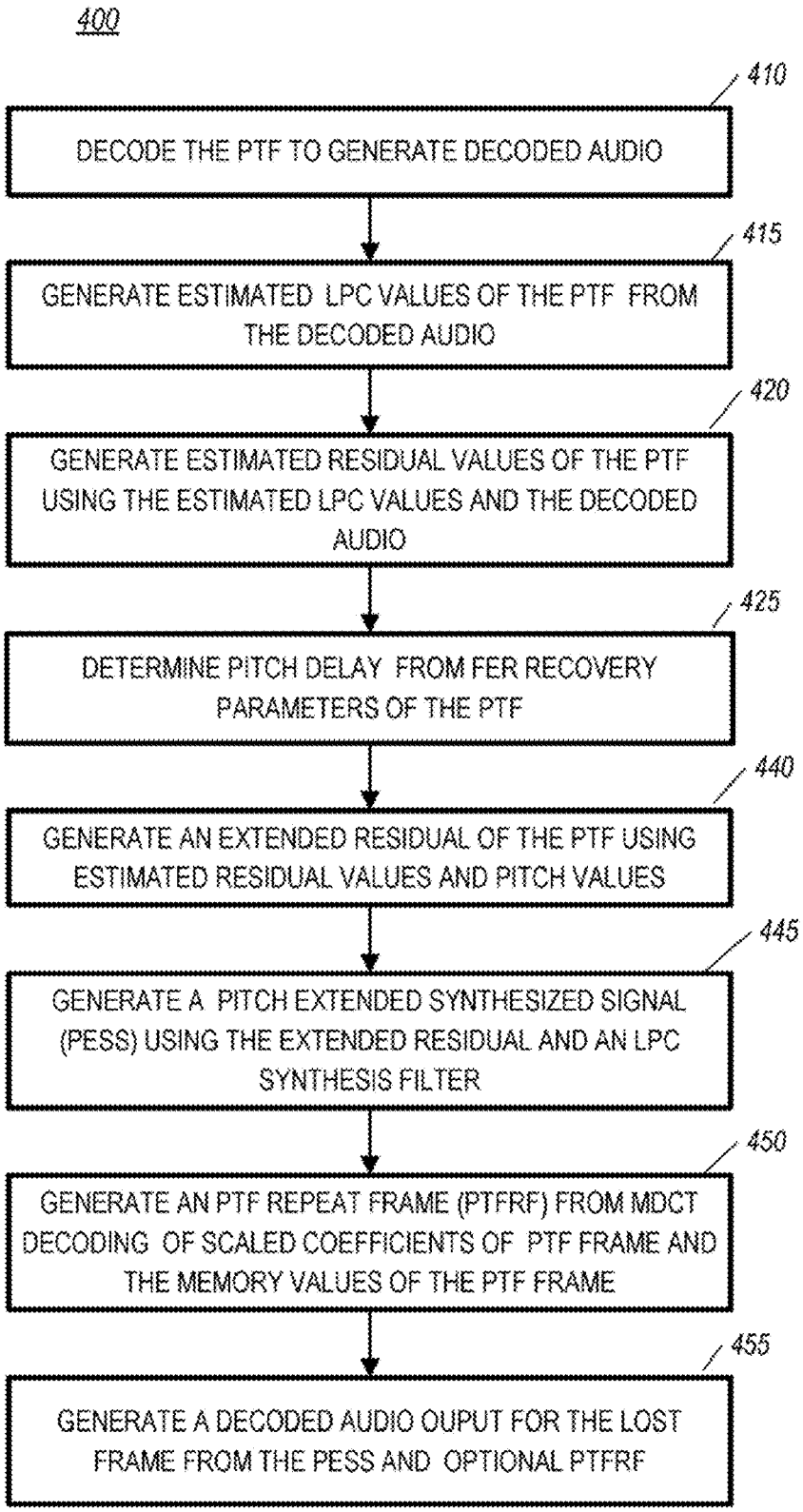
FIG. 4 is a flow chart that shows some steps of performing certain steps described with reference to FIG. 3, according to certain embodiments.

Referring to FIG. 4, a flow chart 400 shows some steps used to complete certain steps of FIG. 3, according to certain embodiments. At step 410, the PTF is decoded using transform domain decoding techniques, generating a decoded audio signal. At step 415, LPC coefficients of the decoded audio of the PTF are determined using LPC analysis techniques. Using the LPC coefficients and the decoded audio of the PTF at step 420, an LPC residual r(n) of the PTF is computed. At step 425 the FER pitch delay is determined from the pitch parameters received with the PTF (part of step 315, FIG. 3). An extended residual for the lost frame r(L+n), wherein L is the length of the frame, is then calculated at step 440 using the FER pitch delay (D) received with the PTF. When there is one lost frame, the extended residual is given by $$r(L+n)=\gamma\cdot r(L+n-D),\ 0\leq n<2\cdot L,\ \gamma\leq 1 \quad (1)$$

wherein γ is a redefined value which may be frame dependent, and wherein n=0 defines the beginning of the lost frame. When only one frame is lost, γ may be 1 or slightly less, e.g., 0.8 to 1.0 (part of step 320, FIG. 3). Note that in equation (1) the extended residual is calculated beyond the length of the lost frame through the next good frame. This provides values for overlap adding with the next good frame, as described below. It may extend longer. For example, when two frames are lost, the extended residual is calculated over the two lost frames and through the next good frame. Thus, when two frames are lost, 2·L may be changed to 3·L and γ may have two values: a $\gamma_1$ value for $0 \le n < L$ and a $\gamma_2$ value for $L \le n < 3 \cdot L$. For example, $0.8 < \gamma_1 \le 1.0$ and $0.3 < \gamma_2 \le 0.8$, and in one specific example, $\gamma_1 = 1.0$ and $\gamma_2 = 0.5$.

The extended residual r(L+n) is passed through an LPC synthesis filter at step 445 using the inverse estimated LPC coefficients, generating the pitch extended synthesis signal (PESS). When there is one lost frame, the PESS is given by $$s_p(n) \text{ for } 0 \le n < 2*L \tag{2}$$

Note that the multiplier for L is larger when more than one frame is lost. E.g., for two lost frames, the multiplier is 3. In certain embodiments, another synthesis signal, referred to herein as the PTF repeat frame (PTFRF) is generated at step 450 based on MDCT decoding of scaled MDCT coefficients of the PTF frame and the synthesis memory values of the PTF frame. The scaling may be a value of 1 when one frame is lost. The decoded scaled MDCT coefficients and synthesis memory values are overlap added to generate the PTFRF. The PTFRF is given by $$s_r(n) \text{ for } 0 < n < L \tag{3}$$

In certain embodiments, a decoded audio signal for the lost frame is generated at step 455 as $$s(n) = w(n) \cdot s_p(n) + (1 - w(n)) \cdot s_r(n),\ 0 \le n < L \tag{4}$$

where w(n) is a predefined weighting function (part of step 325, FIG. 3). The weighting function w(n) is chosen to be non-decreasing function of n. In certain embodiments, w(n) is chosen as:

$$w(n) = \begin{cases} n/m & n < m < L \\ 1 & n \ge m \end{cases}, \tag{5}$$

One value of m that has been experimentally determined to minimize the perceived distortion in the event of a lost frame, over a combination of PTF and next good frame values that represent a range of expected values, is ⅛ L. The reason for using the combination of MDCT based approach and the residual based approach in the initial part of the lost frame following a PTF is to make use of the MDCT synthesis memory of the PTF. In some embodiments the decoded audio for the lost frame is determined with $w(n)=1$ from $0 \le n < L$, or in other words, directly from the PESS (the portion of equation (2) for which $0 \le n < L$).

Figure 5:
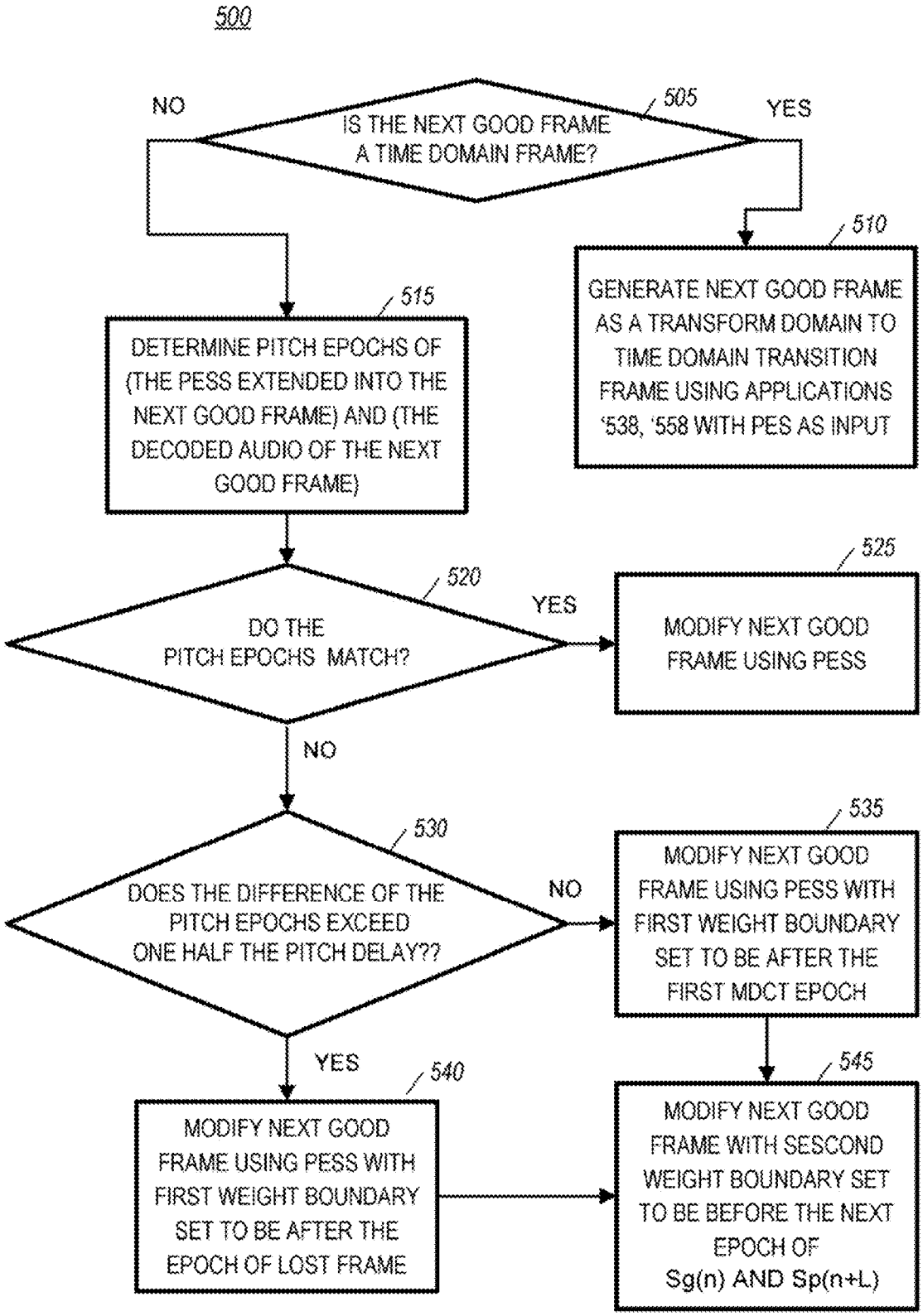
FIG. 5 is a flow chart that shows some steps used to a step of described with reference to FIG. 3, in accordance with certain embodiments.

Referring to FIG. 5, a flow chart shows some steps used to perform the step of generating a decoded audio for the next good frame 335 described with reference to FIG. 3, in accordance with certain embodiments. A determination is made at step 505 as to whether the next good frame is a time domain frame or a transform domain frame. When the next good frame is a transform domain frame, in the next good frame, the pitch extended synthesized signal is extended beyond one frame and the extension is used in the initial part of the decoding of the next good frame to account for the unavailable or corrupted MDCT synthesis memory from the lost frame. At step 515, pitch epochs of the audio output of the lost frame (equation (4)) and the audio output of the next good frame (as received) are determined. The pitch epochs may be identified in a signal as a short time segment in a pitch period which has the highest energy. At step 520, a determination is made as to whether the locations of these two pitch epochs exceed a minimum value, such as 1/16 pitch delay. When they are less than the minimum value, they are deemed to match, and equation (6) may be used in step 525 to modify the audio output of the next good frame based on the PESS with weightings as defined in equation (7). The audio signal $s_g(n)$ in equation (6) is the output of the next good frame using MDCT synthesis. The first audio value of the next good frame is at n=0. The pitch extended synthesized signal, $s_p(n+L)$, in equation (6) expresses the values of the PESS that extend into the good frame.

$$s(n) = w(n) \cdot s_p(n+L) + (1 - w(n)) \cdot s_g(n),\quad 0 \le n < L \tag{6}$$

$$w(n) = \begin{cases} 1 - n/m & n < m \le L \\ 0 & n \ge m \end{cases}, \tag{7}$$

One value of m that has been experimentally determined to minimize the perceived distortion in the event of a lost frame and matching pitch epochs, over a combination of PESS and next good frame values that represent a range of expected values, is ½ L. Alternatively in step 525, when the pitch epochs match, equation (6) may be used to modify the next good frame based on the PESS with an alternative weighting equation (8), in which m1 and m2 have experimentally determined values of weight boundaries that minimize the perceived distortion in the event of a lost frame and matching pitch epochs, over a combination of PESS and next good frame values that represent a range of expected values.

$$w(n) = \begin{cases} 1 & n < m_1 \\ 1 - (n - m_1)/(m_1 - m_2) & m_2 > n \ge m_1. \\ 0 & n \ge m_2 \end{cases} \tag{8}$$

step 520, when the difference of the pitch epoch values do not match, then a determination is made at step 530 as to whether their difference is greater than one half the FER pitch delay obtained with the PTF. When the value of the difference is greater than one half the FER pitch delay, then m1 in equation (8) is set at step 535 to a location after the pitch epoch of the PESS. However, when the value of the difference in step 530 is less than one half the FER pitch delay, the value for m1 in equation (8) is set to a location after the pitch epoch of the audio output of the next good frame (as received). This avoids a problem of cancellation of pitch epochs and/or generation of two pitch epochs which are very close, which results in audible harmonic discontinuity. At step 545, m2 (which is greater than m1) of equation (8) is set to be before the next pitch epoch of the two output signals, which for one lost frame are $S_p(n+L)$ and $S_g(n)$. Now the values of m1 and m2 are set in equation (8) and a modified output signal is generated as the decoded audio for the next good frame for step 335 of FIG. 3.

Thus, the values of $m_1$ and $m_2$ may be fixed in some embodiments or may be dependent on the FER pitch delay value of the PTF and the positions of the pitch epochs of the two outputs (the audio output of the PTF and the audio output of the next good frame). In certain embodiments, a pitch value may be obtained for the next good frame and that pitch value may be used as an additional value from which to determine the values of $m_1$ and $m_2$. If the pitch value of the PTF and the next good frame are significantly different or the next good frame is not a pitch FER frame then equation 6 is used as described above.

Figure 6:
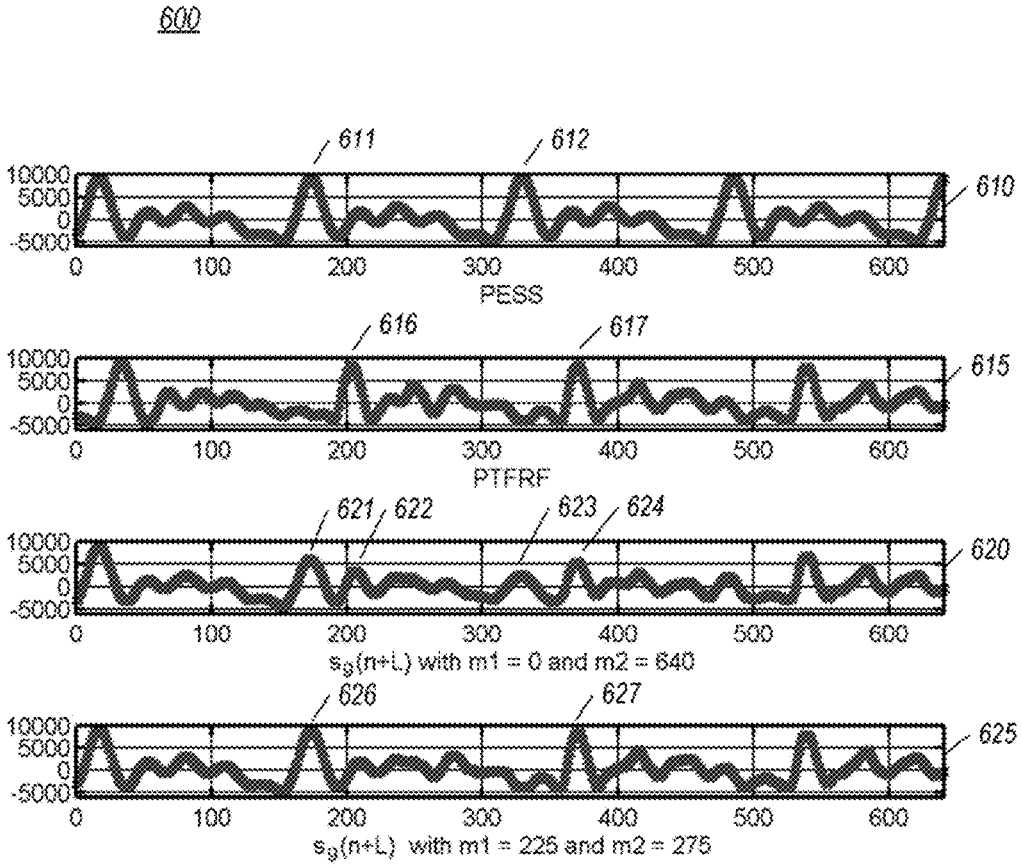
FIG. 6 is a timing diagram of four audio signals that shows one example of a combination of a pitch based signal and a MDCT based signal for generating a decoded audio output for a next good frame, in accordance with certain embodiments.

Referring to FIG. 6, a timing diagram 600 of four audio signals shows one example of a combination of a pitch based signal and a MDCT based signal for generating a decoded audio output for a next good frame, in accordance with certain embodiments. This demonstrates certain benefits of certain embodiments described herein. In FIG. 6, the first audio signal is that portion of a pitch based extended signal 610 generated in accordance with the principles of equation (4) that is within the next good frame, having pitch epochs 611, 612, and expressed as $s_p(n+L)$ in equation (6). The second audio signal is a decoded audio signal 615 for the next good frame as received, $s_g(n)$ having pitch epochs 616, 617. The third audio signal shows a combined output signal 615 for the case in which the pitch based extended signal 610 and the decoded audio signal 615 using $m_1=0$, and $m_2=L=640$. Note that the pitch epochs 621, 622, 623, 624 in the combined output 620 between samples 100-200 and samples 300-400 are "lost" (i.e., their value significantly decreases) because of this particular weighted sum. When the pitch based extended signal 610 and decoded audio signal 615 are combined as shown in combined signal 625 by setting $m_1=225$ and $m_2=275$ according to steps 530, 535, and 540 of FIG. 5, the pitch epoch 626 of the pitch based extended signal 610 $s_p(n+L)$ before sample 225 and the pitch epoch 627 of the decoded audio signal 615 after sample 275, as well as subsequent pitch epochs of the decoded audio signal are retained.

Referring back to FIG. 5, when at step 505 the next good frame is determined to be a time domain frame, then the next good frame is treated as a transform domain to time domain transition frame at step 510, which requires generation of a CELP state for the transition frame. In certain embodiments, the generation of the CELP state is performed by providing as an input to a CELP state generator the decoded audio signal s(n) described in equation (4) in this document, wherein the length of the decoded audio signal s(n) is extended into the next good frame by a few samples (e.g., 15 samples for the a wide band (WB) signal and 30 samples for a super wide band signal (SWB) as defined in ITU-T Recommendation G.718 (2008) and ITU-T Recommendation (2008) Amendment 2 (0310). Thus, the inputs are given by $$s(n)=w(n)\cdot s_p(n)+(1-w(n))\cdot s_r(n),\ 0\le n<L+p \tag{9}$$

wherein p is 15 for a WB signal and 30 for a SWB signal, and $s_p(n)$ is given by equation (2). It will be appreciated that for other types of decoded audio signals, p may be different, and may a value up to L.

In some embodiments, the techniques for using a CELP state generator may be those described in U.S. patent application Ser. No. 13/190,517, filed in the U.S. on Jul. 7, 2011, entitled "Method and Apparatus for Audio Encoding and Decoding" (hereafter "USPAN '517" or U.S. patent application Ser. No. 13/342,462, filed in the U.S. on Jan. 1, 2012, entitled "Method and Apparatus for Processing Audio Frames to Transition Between Differing Codecs" (hereafter "USPAN '462", which are incorporated herein by reference, but with the techniques modified by substituting the above described decoded audio signal as the input to the CELP state generators that are described in USPAN '517 and USPAN '462. The CELP generator in USPAN '462 is described with reference to FIG. 4 of USPAN '462, with the input that is being replaced labeled "RECONSTRUCTED AUDIO (FRAME M)". The CELP generator in USPAN '517 is described with reference to FIG. 5 of USPAN '517, with the input that is substituted being labeled "RECONSTRUCTED AUDIO (FRAME m)". The extension to the decoded audio signal s(n) of equation (4) is obtained by using the pitch extended synthesis signal of equation (2) in generating the output signal of equation (4) and changing the upper length limit of equation (2) accordingly. This approach minimizes a discontinuity that would otherwise result from using the MDCT synthesis memory for extension values from the decoded lost frame that are needed to compensate for the delay of the down sampling filter used in the ACELP part (15). (Use of MDCT synthesis memory as an extension for generating CELP state in frames following lost frames which use PESS would result in discontinuity.) Using the approach described above, an audio output signal is generated at step 510 as the decoded audio output of a transform domain to time domain transition frame for the next good frame for step 335 of FIG. 3.

Figure 7:
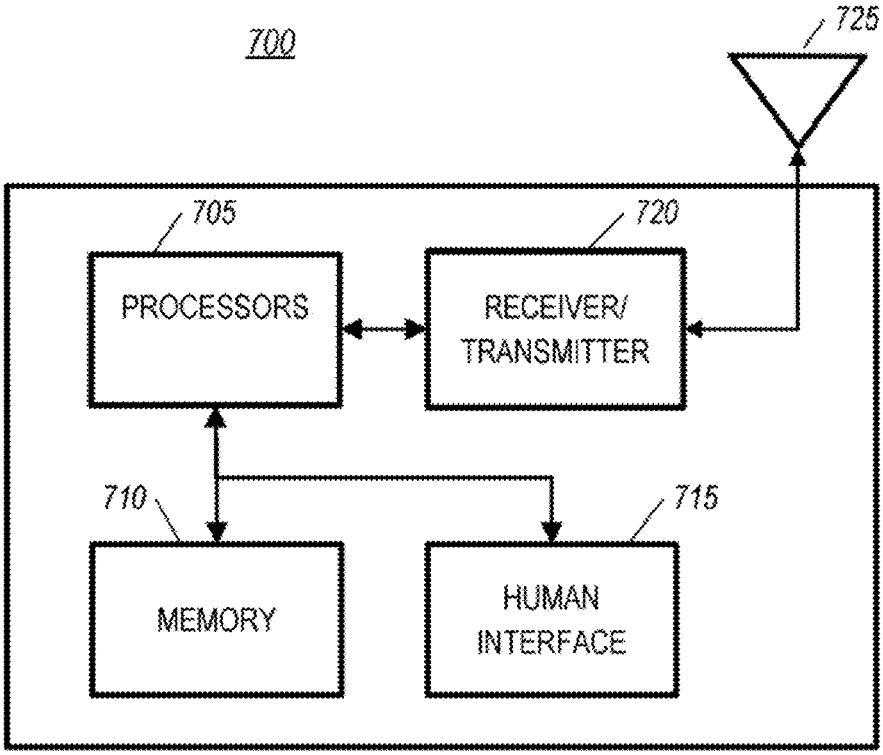
FIG. 7 is a block diagram of a device that includes a receiver/transmitter, in accordance with certain embodiments.

Referring to FIG. 7, a block diagram of a device 700 that includes a receiver/transmitter is shown, in accordance with certain embodiments. The device 700 represents a user device such as UE 120 or other device that processes audio frames such as those described with reference to FIG. 1. The processing may include encoding audio frames, such as is performed by encoder 111 (FIG. 1), and decoding audio frames such as is performed in UE 120 (FIG. 1), in accordance with techniques described with reference to FIGS. 1-6. The device 700 includes one or more processors 705, each of which may include such sub-functions as central processing units, cache memory, instruction decoders, just to name a few. The processors execute program instructions which could be located within the processors in the form of programmable read only memory, or may located in a memory 710 to which the processors 705 are bi-directionally coupled. The program instructions that are executed include instructions for performing the methods described with reference to flow charts 200, 300, 400, and 500. The processors 705 may include input/output interface circuitry and may be coupled to human interface circuitry 715. The processors 705 are further coupled to at least a receive function, although in many embodiments, the processors 705 are coupled to a receive-transmit function 720 that in wireless embodiments such as those in which UE 120 (FIG. 1) operates is a radio receive-transmit function that coupled to a radio antenna 725. In wired embodiments such as those in which encoder 111 (FIG. 1) may operate, the receive-transmit function 720 is a wired receive-transmit function and the antenna is replaced by one or more wired couplings. In some embodiments the receive/transmit function 720 itself comprises one or more processors and memory, and may also comprise circuits that are unique to input-output functionality. The device 700 may be a personal communication device such as a cell phone, a tablet, or a personal computer, or may be any other type of receiving device operating in a digital audio network. In some embodiments, the device 700 is an LTE (Long Term Evolution) UE (user equipment that operates in a 3GPP ($^{3rd}$ Generation Partnership Project) network. It should be apparent to those of ordinary skill in the art that for the methods described herein other steps may be added or existing steps may be removed, modified or rearranged without departing from the scope of the methods. Also, the methods are described with respect to the apparatuses described herein by way of example and not limitation, and the methods may be used in other systems.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The processes illustrated in this document, for example (but not limited to) the method steps described in FIGS. 2-5, may be performed using programmed instructions contained on a computer readable medium which may be read by processor of a CPU. A computer readable medium may be any tangible medium capable of storing instructions to be performed by a microprocessor. The medium may be one of or include one or more of a CD disc, DVD disc, magnetic or optical disc, tape, and silicon based removable or non-removable memory. The programming instructions may also be carried in the form of packetized or non-packetized wireline or wireless transmission signals.

It will be appreciated that some embodiments may comprise one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the methods and/or apparatuses described herein. Alternatively, some, most, or all of these functions could be implemented by a state machine that has no stored program instructions, or in one or more application specific integrated circuits (ASICs), in which each function or some combinations of certain of the functions are implemented as custom logic. Of course, a combination of the approaches could be used.

Further, it is expected that one of ordinary skill, notwithstanding possibly significant effort and many design choices motivated by, for example, available time, current technology, and economic considerations, when guided by the concepts and principles disclosed herein will be readily capable of generating such stored program instructions and ICs with minimal experimentation.

In the foregoing specification, specific embodiments of the present invention have been described. However, one of ordinary skill in the art appreciates that various modifications and changes can be made without departing from the scope of the present invention as set forth in the claims below. As examples, in some embodiments some method steps may be performed in different order than that described, and the functions described within functional blocks may be arranged differently (e.g.,). As another example, any specific organizational and access techniques known to those of ordinary skill in the art may be used for tables. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A method implemented on at least one processor for generating a decoded frame in response to a loss of a frame in an audio codec, comprising:

identifying that a frame is lost;

generating a set of estimated linear predictive coefficients corresponding to a previous transform frame based on a decoded set of audio samples from the previous transform frame;

generating an estimated residual of the previous transform frame based on the set of estimated linear predicative coefficients and the decoded set of audio samples;

determining a pitch delay from a set of frame error recovery parameters received with the previous transform frame;

generating an extended residual based on the pitch delay and the estimated residual;

generating a first synthesized signal based on the extended residual and the set of linear predicative coefficients;

receiving a plurality of coded parameters for a next good frame following the lost frame, wherein the next good frame is a successfully decoded frame;

generating a second synthesized signal for the next good frame further based on the plurality of coded parameters; and generating a decoded audio output of the next good frame based on a first weighted sum of the first synthesized signal and the second synthesized signal wherein the first weighted sum comprises at least two weight boundaries, and wherein the at least two weight boundaries are determined based on a pitch epoch of the first synthesized signal, a pitch epoch of decoded audio of the next good frame, and the pitch delay.

2. The method of claim 1, wherein the plurality of coded parameters are transform coefficients.

3. The method of claim 1, wherein the plurality of coded parameters are LPC and excitation parameters.

4. The method of claim 1, further comprising:

determining that the next good frame is a time domain frame;

generating an extended decoded audio output by extending the length of the decoded audio output of the at least one lost frame by a quantity of samples that is predetermined based on a bandwidth of an audio signal being conveyed by the frame;

coupling the extended decoded audio output to a CELP state generator; and generating the decoded audio for the next good frame based at least upon the output of the CELP state generator.

5. An apparatus for generating a decoded frame following a loss of a frame, wherein the frames are a sequence of encoded audio frames, comprising:

a receiver that receives the sequence of audio frames; and at least one processor that executes program instructions stored in memory, wherein the executed program instructions identify that a frame is lost, generate a set of estimated linear predictive coefficients corresponding to a previous transform frame based on a decoded set of audio samples from the previous transform frame, generate an estimated residual of the previous transform frame based on the set of estimated linear predicative coefficients and the decoded set of audio samples, determine a pitch delay from frame error recovery parameters received with the previous transform frame, generate an extended residual based on the pitch delay and estimated residual, generate a first synthesized signal based on the extended residual and the linear predicative coefficients, receive a plurality of coded parameters for a next good frame following the lost frame, wherein the next good frame is a successfully decoded frame;

generate a second synthesized signal for the next good frame further based on the plurality of coded parameters; and generate a decoded audio output of the next good frame based on a first weighted sum of the first synthesized signal and the second synthesized signal, wherein the first weighted sum comprises at least two weight boundaries, and wherein the at least two weight boundaries are determined based on a pitch epoch of the first synthesized signal, a pitch epoch of decoded audio of the next good frame, and the pitch delay.

6. The apparatus according to claim 5, wherein the executed program instructions further:

determine that the next good frame is a time domain frame;

generate an extended decoded audio output by extending the length of the decoded audio output of the at least one lost frame by a quantity of samples that is predetermined based on a bandwidth of an audio signal being conveyed by the frame;

couple the extended decoded audio output to a CELP state generator; and generate the decoded audio for the next good frame based at least upon the output of the CELP state generator.

* * * * *